United States Patent [19]

Yeh

[11] Patent Number: 4,903,354

[45] Date of Patent: Feb. 27, 1990

[54] HEADBOARD CONNECTION DEVICE

[76] Inventor: John Yeh, 660 S. Aberdeen, Anaheim Hills, Calif. 92807

[21] Appl. No.: 338,629

[22] Filed: Apr. 17, 1989

[51] Int. Cl.[4] ..... A47C 17/02; A47C 19/02

[52] U.S. Cl. ..... 5/53 R; 5/51 B; 5/282 R; 403/292

[58] Field of Search ..... 5/51 B, 53 R, 282 R, 5/285, 201; 403/292, 295, 298

[56] References Cited

U.S. PATENT DOCUMENTS

| | | | |
|---|---|---|---|
| 3,000,656 | 9/1961 | Hollaender | 403/292 |
| 4,651,362 | 3/1987 | Alperin et al. | 5/51 B |
| 4,691,818 | 9/1987 | Weber | 403/292 |
| 4,754,506 | 7/1988 | Yeh | 5/53 R |
| 4,821,349 | 4/1989 | Cohen | 5/53 R |

FOREIGN PATENT DOCUMENTS

| | | | |
|---|---|---|---|
| 2289702 | 5/1976 | France | 403/298 |

*Primary Examiner*—Alexander Grosz

*Attorney, Agent, or Firm*—Francis X. LoJacono

[57] ABSTRACT

A headboard for a sofa bed or a daybed wherein the headboard is defined by a pair of oppositely disposed and aligned half sections mounted together by means of securing connectors whereby the upper and lower rails are coupled together. The securing connectors are formed from an elongated body defining a brace member. The brace member includes laterally extended arm members positioned between the ends of the brace member whereby oppositely disposed connector lug members are defined. These connector lugs are secured in slots formed in the respective free ends of each half section. A joint plate is also employed and is adapted to be inserted in selected slots of the rail members.

3 Claims, 2 Drawing Sheets

HEADBOARD CONNECTION DEVICE

BACKGROUND OF THE INVENTION

The present invention relates generally to bed structures, and more particularly to a joint connector for the headboard frame member of the well-known convertible sofa-bed or daybed, wherein such a bed structure includes a pair of oppositely disposed sideboard frame members and a two-piece headboard frame member.

Many types of side-board and headboard frame members of various configurations are presently in use. However, the structures of these known frame members have features which restrict their use. They also are very expensive to ship due to the difference in sizes between the headboards and companion sideboard members. More specifically, the length of each sideboard frame member of a sofabed or daybed is commonly of the same dimension as the width of a single bed mattress, whereas the headboard frame member is constructed as having approximately the same length as the elongated longitudinal side of a single bed or mattress which is substantially twice the length of a sideboard member.

Accordingly, the shipping containers presently in use for these board members are sized to readily receive and protect the largest structures which are the headboards. Such large sized containers, however, require more shipping space and thus transportation by ship or truck becomes very costly. One may refer to U.S. Pat. No. 4,754,506 by the present inventor which is designed more specifically for metal-frame bed structures.

SUMMARY OF THE INVENTION

The present invention comprises a novel connecting device for securing a pair of half sections of a headboard that is suitable for use in bed structures, and more particularly for daybeds. Each headboard requires a pair of connecting devices which are centrally positioned between the two oppositely disposed headboard frame members when the two half sections are attached together. As will be hereinafter described in detail, each joint connector allows the headboard member to be shipped in two-piece dismantled sections, each half section having an approximate length of the corresponding sideboard frame members. It should be particularly noted that the present invention is more specifically designed for headboards.

Thus, the present invention has for an important object a provision for a daybed that can be readily shipped in a disassembled mode to provide two half sections of near equal length to generally match the size of the associated sideboard. members, whereby the disassembling or reassembling is established by at least a pair of connectors interposed between the corresponding half sections.

Still another object of the invention is to provide a means whereby the back or headboard frame, that is formed by two sections can be readily coupled together as a single elongated frame section wherein the means that is provided comprises a connection unit defined by a truss member formed having an elongated body which includes a pair of centrally positioned arm members that extend laterally outward of the body section. A U-shaped keeper member is also included and adapted to be mounted in open ends of one of the half-sections to receive a free end of the truss member.

It is still another object of the present invention to provide a connector wherein each free end of the truss members is received in respective recesses formed in the extended ends of each halfsection of the headboard, with the truss member being secured thereto by means of screws or bolts.

Still another object of the present invention is to provide a connector of this character wherein a minimum amount of securing screws or bolts is required for the assembly of the two half sections of the headboard, It is another object of the present invention to provide a connector of this type which allows the two matching half sections to be easily assembled with the use of a screwdriver.

A further object of the invention is to provide a headboard having two half sections of a headboard which can be readily stored in the same size shipping container or carton as the associated side board frame member.

A still further object of the invention is to provide a simple means whereby a two-piece headboard frame member is easily assembled and secured.

Still another object of the invention is to provide a connector suitable for use with wood-frame structures that is readily arranged to conform to the design and usage of the bed.

A further object of the present invention is to provide a device of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements of modes of operation that are properly within the scope of the appended claims.

BRIEF DESCRITION OF THE DRAWINGS

Novel features and advantages of the present invention in addition to those mentioned above will become apparent to those skilled in the art from reading the following detailed description in conjunction with the accompanying drawings wherein.

DESCRIPTION OF THE PREFERRED EMBODIMENT

Figure 1:
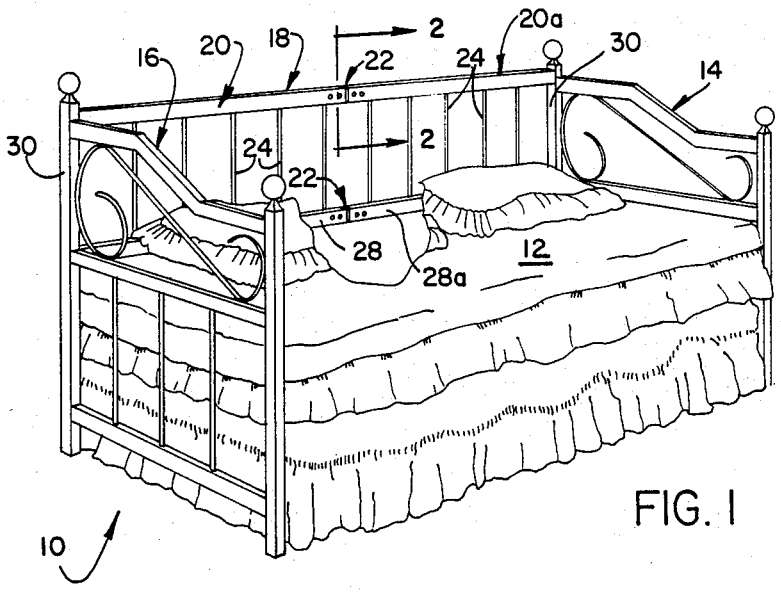
FIG. 1 is a pictorial view of a typical type sofa bed or daybed showing the placement of the joint connectors so as to define the oppositely disposed half sections of the backboard frame.
Figure 2:
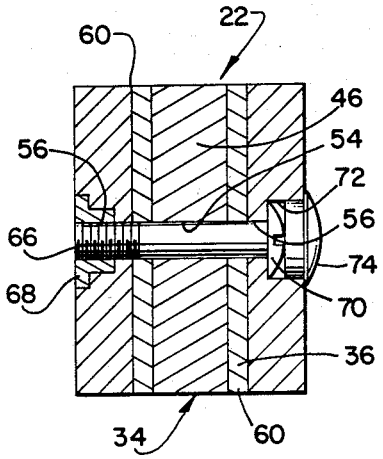
FIG. 2 is an enlarged cross-sectional view taking along line 2—2 of FIG. 1 of the truss member secured within the keeper member and the bed rail.

Referring more particularly to FIG. 1, there is shown a pictorial view of a sofa bed or daybed, generally indicated at 10, having a typical single bed mattress 12 normally provided with a hidden trundle bed positioned thereunder. Daybeds typically include sideboard frame members, indicated generally at 14 and 16, each being secured and positioned adjacent the ends of the bed. A headboard frame member, designated at 18, interconnects each sideboard member and extends the full length of the bed, but only along one side thereof, whereby a sofa-type arrangement is established.

Headboard 18 is defined by an elongated frame structure comprising a plurality of extended bars or tube members which are secured together and arranged to establish two connected half-frame sections 20 and 20*a* constructed with compatible design configurations, as seen in FIG. 1. These two half-frame sections are assembled to form the elongated headboard 18. This is accomplished by employing novel-designed connector means, generally indicated at 22, which secure the half-frame sections together.

Accordingly, each half section must basically include an upper rail, a lower rail, an end post and strut support means for supporting and positioning the upper and lower rails in a substantially parallel relationship to each other.

Half sections 20 and 20*a* are constructed in an identical manner. Half section 20 comprises an upper substantially horizontal strut rail 26 and a lower horizontally positioned strut rail 28, with half section 20*a* being formed identically to half section 20, but having a reverse arrangement thereto. Thus, half section 20*a* includes an upper substantially horizontal strut rail 26*a* and a lower strut rail 28*a*. Accordingly, the upper and lower strut rail members are secured in a substantially parallel position with respect to each other by means of any suitable securing structure, as illustrated at 24 in FIG. 1. Thus, for simplicity, vertical rods are shown secured between the respective rails 26 and 28, and 26*a* and 28*a*. The ends of each half section are provided with vertical end posts 30, which are secured to the ends of the respective upper and lower rails. When the bed frame is erected as illustrated in FIG. 1, sideboard frame sections 14 and 16 are secured to the respective end post members 30. Sideboard frame sections 14 and 16 may have various design configurations that would be appropriate to match that of the total headboard.

However, prior to securing sideboards 14 and 16 to post 30, half sections 20 and 20*a* are secured together by connectors 22 to form a complete, single elongated headboard 18. Thus, a pair of connectors 22 is employed, one connecting the oppositely disposed upper rail members 26 and 26*a* and the other connector connecting the oppositely disposed, lower rail members 28 and 28*a*.

The connecting device 22 is the same in structure and design for securing both the upper and lower rail members, and comprises a strut or brace member, generally indicated at 34, and a keeper member 36.

Figure 3:
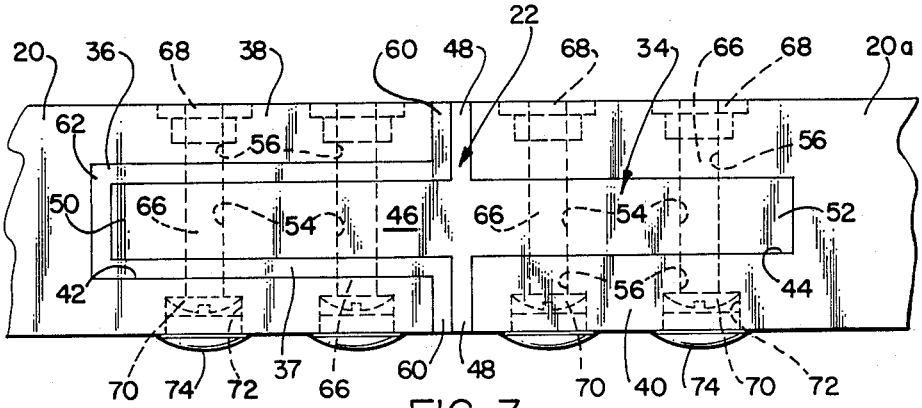
FIG. 3 is an enlarged top plan view of the present invention shown fully mounted and secured to each half section thereof.
Figure 4:
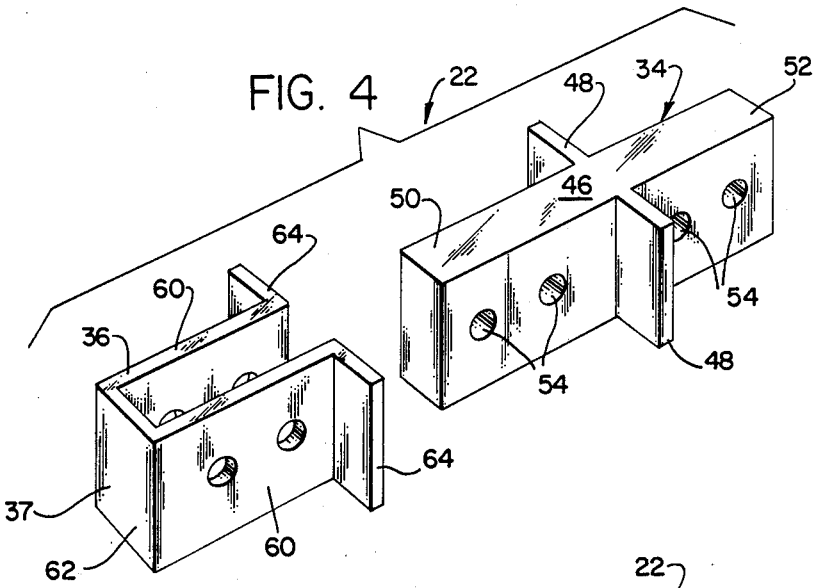
FIG. 4 is an exploded view of the truss member including the associated keeper member.

In FIG. 3, there is shown a top plan view of the oppositely positioned free ends of strut rails 20 and 20*a*, respectively, which are coupled together by means of connecting device 22. Each free end 38 and 40, of rails 20 and 20*a* is formed having an elongated notch 42 and 44 respectively. Notch 42 is adapted to receive keeper member 36 therein, while notch 44 is adapted to receive one end of the brace member 34. Brace or strut member 34 is formed having an elongated body member 46 which is divided along its length thereof by laterally extended arm members 48. These arm members are positioned intermediate the ends of body member 46, thus defining a pair of connector lugs 50 and 52. Each connector lug is provided with at least one transverse bore 54. Preferably, two bores are employed as shown in FIG. 4, and are positioned to be aligned with corresponding bores or holes 56 disposed in the respective free ends 38 and 40 of rails 20 and 20*a*.

Keeper member 36 is formed to define a somewhat U-shaped joint plate 37 having side plates 60, and a bottom plate 62. The free ends of each side plate 60 are bent outwardly to define flange plates 64. Holes 65 are also located in side plates 60 and are aligned with bores 54 and 56.

Accordingly, when frame sections 20 and 20*a* are to be secured together, keeper member 36 is inserted into slot or notch 42 of rail 20, and connector lug member 52 is inserted into slot or notch 44 formed on rail 20*a*. Securing means such as bolts 66 are positioned through the bores 56 of free end 40 and bores nuts 68. It should be noted that nuts 68 can be any suitable type but preferably, as shown, they are be recessed within the respective bores 56, and with the bolt heads 70 being countersunk into holes 72 and covered by plugs 74.

Lug member 50 is the inserted into keeper member 36 whereby all of the corresponding holes and bores are aligned to receive bolts 66 in the same manner as described above wherein nuts 68 are recessed so as to be flush with the surface of rail member 20. When strut member 34 is fully secured within joint plate 37, arms 48 of strut member 34 abut against flange members 60 of joint plate 37, as seen in FIG. 3. It should be understood, however, that with certain materials used for the rails, keeper member 36 would not be required and slot 42 would be adapted to receive lug member 50 in a secure manner.

Figure 5:
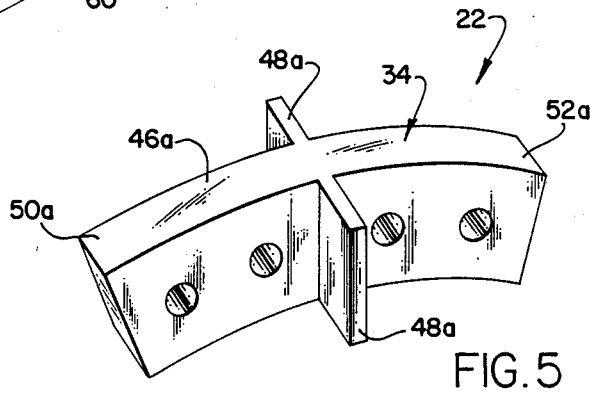
FIG. 5 is a perspective vies of an alternative arrangement of the truss member.

An alternative arrangement of brace or scrut member 34 is illustrated in FIG. 5, wherein body member 46*a* is formed having an arcuate configuration with lug members 50*a* and 52*a* being curved downwardly and outwardly from arm members 48*a*.

Figure 6:
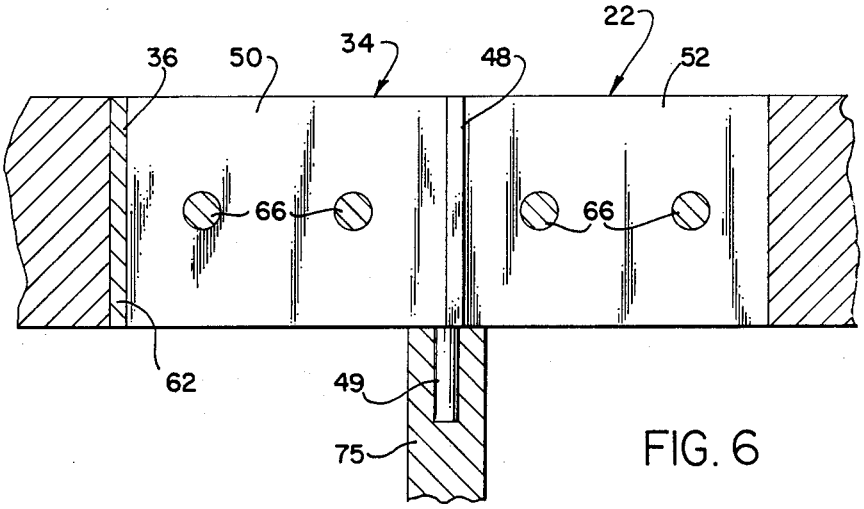
FIG. 6 is a sectional view showing another arrangement of the truss member that is used to also support a vertical rail member.

FIG. 6, also discloses a second arrangement of brace member 34 wherein a center pin 49 is integrally formed therewith. Center pin is used whenever the design of a headboard requires a centrally positioned vertical post, such a indicated at 75.

The foregoing is a description of a preferred embodiment of the invention which is given here by way of example only. The invention is not to be taken as limited to any of the specific features as described, but comprehends all such variations thereof as come within the scope of the appended claims.

What I claim is:

1. In combination, a sofa bed or a daybed having a frame structure including:

a pair of oppositely disposed sideboards and a headboard, wherein said headboard comprises a first half section and a second half section, said half sections being secured together to define a single elongated headboard, said half sections having upper and lower rail members provided with elongated end slots formed in the free ends of said rail member; and connecting means interposed between said half sections to secure said half sections together wherein said connection means comprise a brace member defined by an elongated body member with a pair of connector lug members defined by its end portions and a pair of oppositely disposed arm members which extend laterally from a central portion of said body member, said connecting means further including a joint plate for mounting in at least one of said end slots, said joint plate being formed to receive a connector lug member of said brace member, said joint plate having a pair of side plate members, a bottom plate member and outwardly formed flange members formed in said side plate members whereby said arm members of said brace member abut said respective flange members, said connecting means further including means for fixedly securing said connector lug members to said half sections to form a single headboard frame member by positioning a pair of connector lug members in respective end slots of said upper and lower rail members.

2. The invention as recited in claim 1, wherein said brace member includes a mounting pin.

3. The invention as recited in claim 1, wherein said brace member is formed having an arcuate configuration.

* * * * *